US008721121B1

(12) United States Patent
Briles

(10) Patent No.: US 8,721,121 B1
(45) Date of Patent: May 13, 2014

(54) DECORATIVE LIGHT STRING WITH BLINKING LIGHTS

(76) Inventor: Roger Daniel Briles, Belews Creek, NC (US)

( * ) Notice: Subject to any disclaimer, the term of this patent is extended or adjusted under 35 U.S.C. 154(b) by 90 days.

(21) Appl. No.: 12/928,836

(22) Filed: Dec. 21, 2010

Related U.S. Application Data

(60) Provisional application No. 61/284,807, filed on Dec. 24, 2009.

(51) Int. Cl.
*F21S 4/00* (2006.01)
*F21V 21/00* (2006.01)

(52) U.S. Cl.
USPC ..... 362/249.14; 362/249.16; 362/249.18

(58) Field of Classification Search
USPC ..... 362/249.14, 249.16, 249.18, 249.19
See application file for complete search history.

(56) References Cited

U.S. PATENT DOCUMENTS 4,223,248 A * 9/1980 Tong ..... 315/185 S
4,253,045 A 2/1981 Weber
4,675,575 A 6/1987 Smith et al.
5,404,279 A * 4/1995 Wood ..... 362/145
5,481,444 A * 1/1996 Schultz ..... 362/249.14
5,513,081 A * 4/1996 Byers ..... 362/145
5,601,361 A * 2/1997 Lawrence ..... 362/238
5,828,183 A * 10/1998 Wang et al. ..... 315/185 S
5,967,644 A 10/1999 Pan
5,971,563 A 10/1999 Maggio
6,367,952 B1 4/2002 Gibboney, Jr.
6,474,841 B1 * 11/2002 Rahman ..... 362/249.14
6,497,498 B2 * 12/2002 Adams ..... 362/418
RE38,900 E * 11/2005 Rostoker et al. ..... 438/14
7,063,442 B2 * 6/2006 Sugar ..... 362/249.16
7,070,302 B2 7/2006 Lin
7,125,142 B2 * 10/2006 Wainwright ..... 362/231
7,342,327 B2 3/2008 Janning
7,344,275 B2 3/2008 Allen et al.
7,455,426 B2 11/2008 Lai
7,508,141 B2 3/2009 Wong
7,649,322 B2 1/2010 Neuman et al.
7,731,396 B2 * 6/2010 Fay et al. ..... 362/391
8,083,276 B2 * 12/2011 Schopp ..... 294/24

OTHER PUBLICATIONS

Holiday Litesource Wholesale Catalog, p. 14, 2009.
Rogesr's Products, Inc. Catalog, 2009 http://www.rogersproducts.com/luminaries.html.

* cited by examiner

*Primary Examiner* — John A Ward
(74) *Attorney, Agent, or Firm* — Robert W. Pitts

(57) ABSTRACT

A decorative lighting string including blinking or twinkling lights spaced apart by at least three feet and preferably approximately six feet on a light string will create the effect of twinkling starlight or flickering firelight when used as part of a decorative scheme, such as Christmas decorations. This decorative lighting display is especially suited for outdoor use and can be effectively used in deciduous trees after they have lost their leaves. Twinkling lights that emit an illuminate of at least 40 lumens are especially suited for outdoor use. A random, irregular lighting pattern in which the lights do not appear to be connected by a light string provides the illusion of twinkling lights suspended in mid-air in a dark or darkening sky.

18 Claims, 8 Drawing Sheets

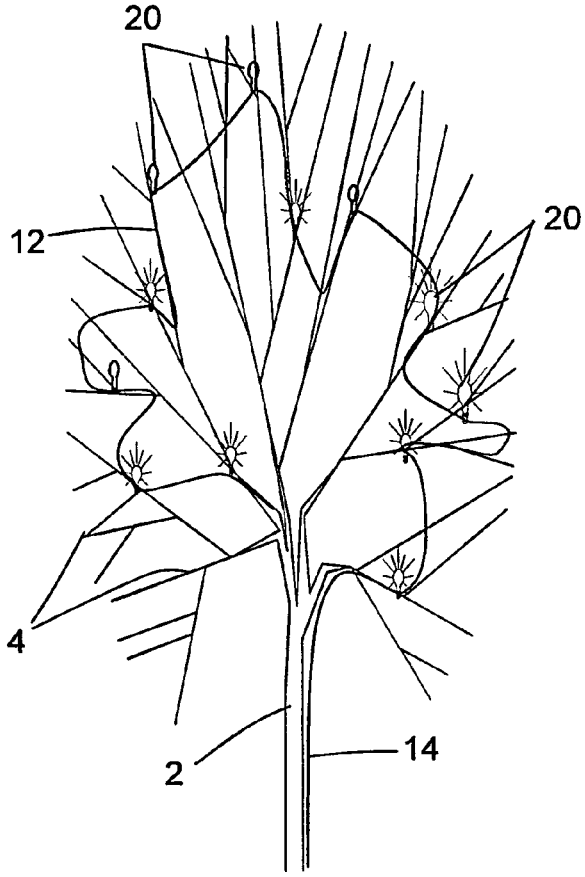
FIG 1
FIG 2
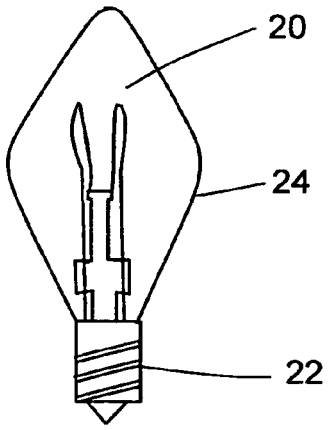
FIG 3
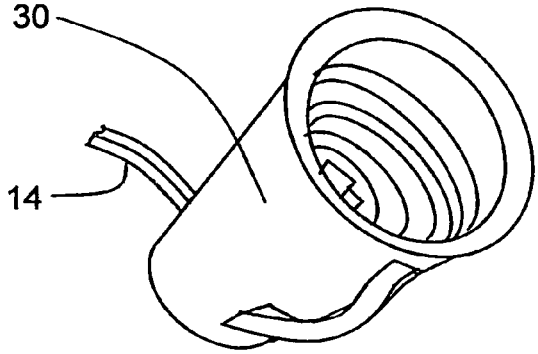

FIG 6A'
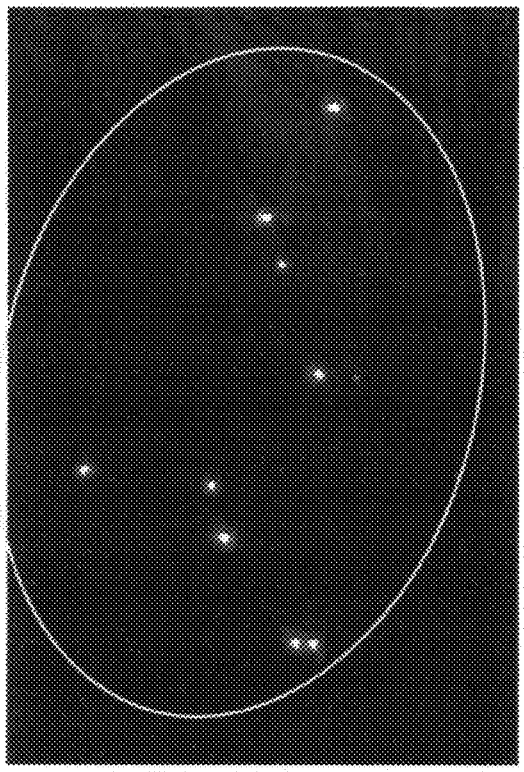
FIG 6B'
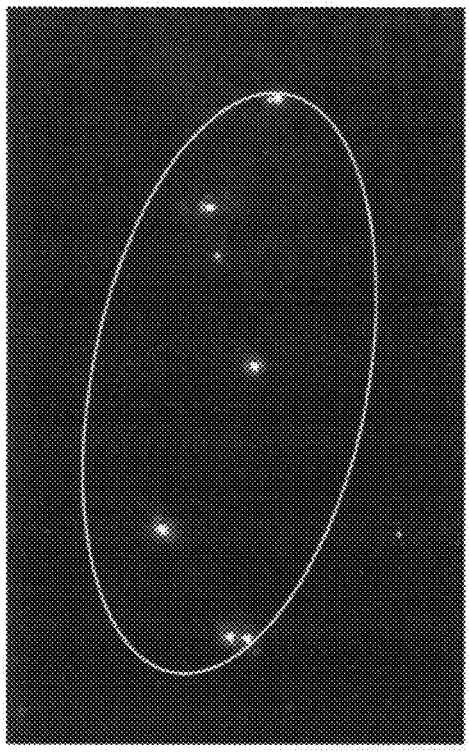
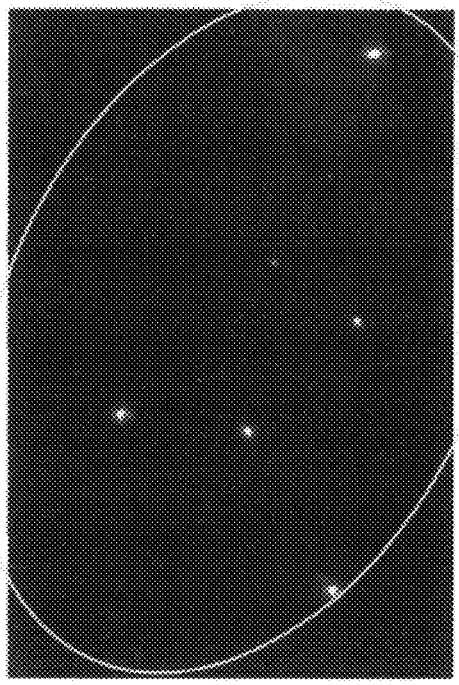
FIG 6C'
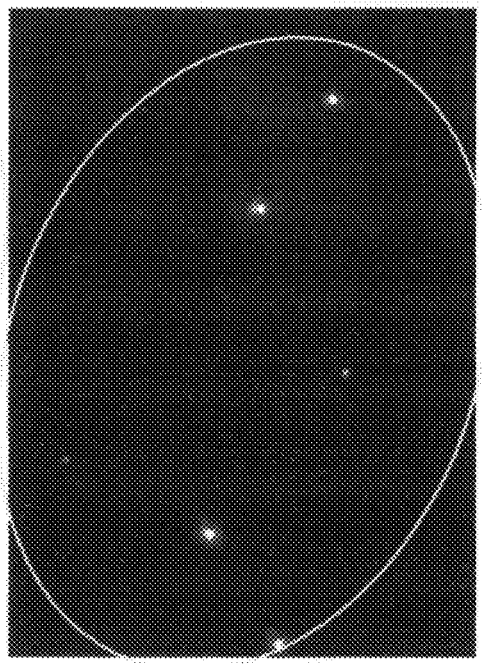
FIG 6D'

DECORATIVE LIGHT STRING WITH BLINKING LIGHTS

CROSS REFERENCE TO PRIOR COPENDING APPLICATION

This application claims the benefit of prior U.S. Provisional Patent Application 61/284,807 filed Dec. 24, 2009.

BACKGROUND OF THE INVENTION

1. Field of the Invention

This invention is directed to an apparatus and method using twinkling electrical lights to form at least a part of a decorative display, and in particular to outdoor decorations suitable for use during at least the Christmas holidays.

2. Description of the Prior Art

Twinkling or blinking lights are used as part of decorative lighting strings. In most blinking light strings, the lights blink on and off in a pattern. For example, the lights may blink progressively on an off in a repetitive pattern from one end of the string to another. In this type of decorative light string most of the lights will be on at any given instant of time.

Independently blinking lights are used as part of a light string in which the lights are push-in miniature lights or midget screw or miniature-screw lampholders. However, as described in U.S. Pat. No. 6,474,841, twinkle light sets using miniature bulbs require a minimum of fifty bulbs of which at least twenty five are steady-burning bulbs. Therefore a large portion of these miniature lights are always on. These miniature lights are also intended for indoor use and they amount of illumination provided by any single bulb, whether it be a steady bulb or a twinkling bulb is not large. The visual effect is the twinkling of the entire light string not the twinkling of individual lights in the string. These light strings are therefore not suitable for use in creating an illusion that the twinkling lights are blinking in a random manner and are not connected as part of a string which may include steady burning lights. These light strings are also generally not suitable for outdoor use as part of a larger holiday decorating scheme.

Large bulbs with a twinkling effect are available in sizes that will provide sufficient illumination for outdoor lighting where the twinkling bulbs can be seen at a distance. However, when these bulbs are strung together at normal light string spacings, the intensity of the illumination together with the rapid on/off cycling of the bulbs creates a busy, cluttered effect that is not pleasant, and therefore would not be suitable for use as part of a decorating scheme. The instant invention, however, provides a light string that can be used to disperse the twinkling lights in an irregular pattern on a supporting member, such as a deciduous tree that has lost its leaves, so that the twinkling lights appear to blink independently and to be suspended in space or in mid-air. These twinkling or blinking lights thus create the illusion of twinkling starlight against a dark or darkening sky or of flickering fire light, especially when used as part of a larger holiday display, in which the twinkling lights can form a background.

SUMMARY OF THE INVENTION

An outdoor decorative lighting display according to this invention is formed by a light string including a plurality of electrical lights. The string includes a plurality of sockets to which the electrical lights are connected. Adjacent sockets being spaced apart by a distance of greater than three feet so that adjacent electrical lights can be spaced apart at differing distances to irregularly disperse the electrical lights are on a supporting member, such as a tree. The individual lights are intermittently illuminated so that the plurality of electrical lights form random, illuminated, intermittent, twinkling, irregular patterns formed by adjacent lights spaced apart sufficiently to eliminate the perception of an ordered array of lights.

This invention also comprises a method of decorating a tree comprising the following steps. Electric lights are positioned on an electrical cord with a minimum spacing of three feet between adjacent lights to form a light string. The light string is suspended from limbs of the tree with the lights being irregularly spaced on the tree. The light string is connected to a source of electricity so that the electric lights randomly blink so that only a portion of the lights are simultaneously illuminated, with individual lights remaining illuminated so that the light string creates a twinkling effect, with the lights being sufficiently dispersed on the tree so that the lights do not appear to be strung together in a line.

This invention also comprises a method of decorating an outdoor scene to simultaneously create the illusions of twinkling starlight and of flickering firelight at night. The method comprises the step of suspending light strings from outdoor supporting members in which adjacent electric sockets on the string are spaced apart by a distance of between three feet and six feet on the strings, but are irregularly spaced on the supporting members. Blinking electric lights are connected in the sockets so that lights in each string blink on and off randomly and independently of the other blinking lights in the string. When the outdoor scene is viewed from a distance, the lights twinkle at random intervals and the spacing between illuminated lights continuously changes to create the simultaneous illusion of twinkling starlight and/or flickering flames.

BRIEF DESCRIPTION OF THE DRAWINGS

FIG. 1 is a view showing a string of blinking lights according to this invention located in a tree.

FIG. 2 is a view of one of the blinking lights that is used in the preferred embodiment of this invention.

FIG. 3 is a view of one of the sockets on the string of this invention in which one of the blinking lights of FIG. 2 can be mounted.

FIGS. 6A'-6D' are photographs taken in the dark showing the effect of the lights. The photographs of FIGS. 6A'-6D' correspond respectively to the inverted images of FIGS. 6A-6D.

FIGS. 7A and 7B also show the use of the blinking light string in the presence of other light sources. FIGS. 7A and 7B are inverted images in which illuminated bulbs appear as a dark image. FIGS. 7A' and 7B' are photographs taken in the dark to show the effect of the lights. The photographs of FIGS. 7A' and 7B' correspond respectively to the inverted images of FIGS. 7A and 7B.

FIGS. 8A and 8B are inverted images so that illuminated lights appear darkened. FIGS. 8A' and 8B' are photographs corresponding respectively to the inverted images of FIGS. 8A and 8B.

DETAILED DESCRIPTION OF THE PREFERRED EMBODIMENT

Figure 4:
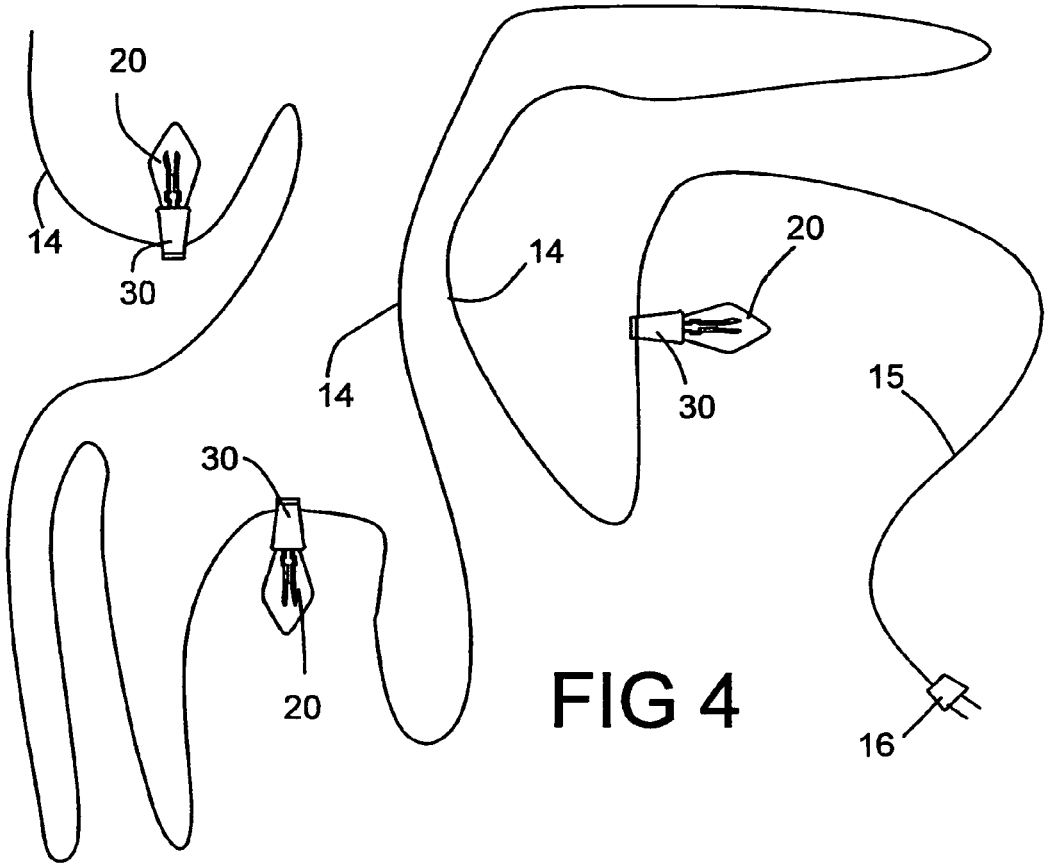
FIG. 4 is a view of a portion of a light string according to this invention, demonstrating the spacing of the blinking lights on the light string.
Figure 5:
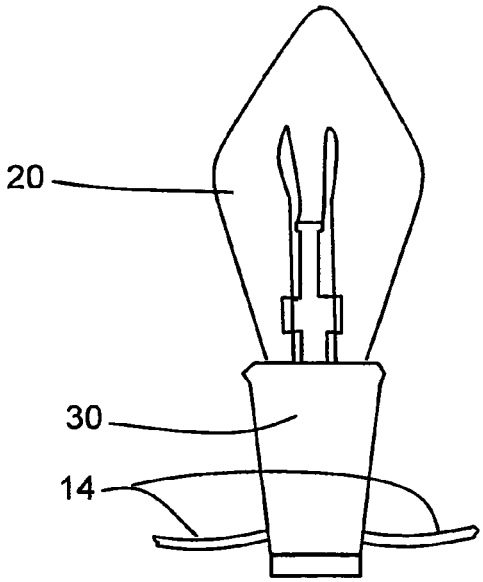
FIG. 5 is a view of one of the blinking lights mounted in a socket in the string of FIG. 4.

The decorative lighting assembly 10 of the this invention comprises a light string 12 including a plurality of blinking or twinkling lights 20 that are spaced apart to produce a random light display that has been said to create the illusion of a flickering fire or twinkling starlight. The light string 12 can be mounted on a support member and in the dark only the twinkling or blinking lights 20 will be visible. Although primarily intended to be mounted on a tree, similar effects can be created by mounting the light string 12 on other support member, such as the top of a roof. This decorative lighting assembly 10 is especially intended for outdoor use, although in some instances a similar effect could be created as part of an indoor decoration. When used outdoors, this decorative lighting assembly 10 creates an especially appealing appearance when the light string 12 is draped from the limbs of a deciduous tree that has lost its leaves. It is therefore especially suited to be part of an outdoor Christmas decorative scene, since many such trees have lost their leaves at the beginning of or during the Christmas season.

An important aspect of this invention is that the adjacent lights 20 be spaced apart by a distance sufficient to create the illusion of randomly illuminated blinking discrete point light sources. The blinking lights 20 or point light sources should not be so close together that they create a busy effect or so that the lights appear clumped together or appear to be in a regular pattern, such as would be apparent when conventional blinking, miniature light strings encircle an indoor, evergreen Christmas tree. Adjacent blinking lights 20 should also be spaced apart by a distance so that spacing will be maintained between lights even when the light string is mounted on the bare limbs of a tree. It will not be possible, without an unwarranted amount of effort, to maintain maximum spacing between adjacent lights 20 mounted on tree limbs. It has been found that if blinking lights 20 are spaced apart by a distance of six feet on a light string 12, an adequate spacing can easily be achieved if the light string 12 is hung from unevenly spaced tree limbs 4. The appropriate light spacing can be achieved both near the base of the tree limbs 4 and at elevated positions in the tree where the spacing between adjacent tree limbs 4 is greater. Thus the decorative lighting assembly 10 of this invention can be easily positioned to achieve the desired effect without any experience or instruction on properly positioning the lights 20. When the lighting string 12 is mounted on the limbs of a deciduous tree, it is not even necessary to encircle the tree with the light string 12, since the lights 20 will be visible from all directions with limited interference. Furthermore, the decorative lighting assembly 10 is not intended to primarily decorate a tree, but is instead intended to create the appearance of twinkling lights 20 suspended in space or in mid-air. When the decorative lighting assembly 10 of this invention is used on a number of trees, such as trees lining a street, the twinkling lights 20 create a backdrop for other traditional Christmas decorations and lights.

FIG. 1 shows one light string 12 having twelve twinkling lights 20 mounted on the limbs 4 of a tree 2. As shown in FIG. 1, eight of the twelve lights 20 would be illuminated at the specific instant represented by FIG. 1, while four of these lights 20 would be dark. Note the rays projecting from the illuminated blinking or twinkling lights 20. At the next instant, the pattern of illuminated lights would be different. In the twelve light string 12 shown in FIG. 1, adjacent lights 20 would be spaced apart by a distance of six feet along the cord 14. Note, however, that adjacent lights 20 would not be spaced apart by six feet when mounted in the tree 2 as illustrated in FIG. 1, and there could be significant slack in the cord between adjacent lights 20 as dictated by the structure of the particular tree being decorated.

In the preferred embodiment of this invention, incandescent C7, 7 watt, 120 volt clear glass bulbs 24 with a candelabra base 22 are employed as shown in FIG. 2. An incandescent C7 bulb is a standard bulb size having a base with the diameter of 0.875 inches. Although the amount of illumination provided by such lights 20 may vary, it is believed that C7 incandescent lights of this type will provide an illumination of 40 lumens or more. In any case the use of bulbs of this type has been found especially suited to create the illusion of starlight against a dark or darkening sky or the illusion of flickering firelight when the light string 12 is used on deciduous trees 2. It has been found that the illusion of starlight is effective when a single tree decorated in this manner is viewed from a distance of approximately one half mile.

In the preferred embodiment of this invention twelve screw type sockets 30 are evenly positioned on a cord 14 at a spacing of six feet. A leader 15 having a length of three feet is provided between a plug 16 and the first socket 30 on one end of the string 12 as shown in FIG. 4. A receptacle can be placed on the opposite end, at a spacing of three feet so that multiple light strings 12 can be plugged together to create adequate coverage when used in large trees. A single string of twelve twinkling or blinking lights 20 would have a length of seventy-two feet.

In the preferred embodiment, each light 20 blinks independently of the other lights 20 forming the light string 12. This can be achieved by employing twinkle lights that have a shunt circuit and a thermally sensitive element or switch, which opens or closes the circuit to the illuminating filament as a function of temperature. When the circuit to the filament is open the current flows through the shunt circuit. In the preferred embodiment, the circuit to the illuminating filament is closed until the flow of current heats the thermally sensitive element or switch to a point at which the element or switch opens so that current flows through the shunt circuit and not through the illuminating filament. The thermally sensitive element or switch cools when current is diverted through the shunt circuit until the thermally sensitive switching element will close, again directing current to the illuminating filament so that the twinkling light 20 will again be illuminated. Thus each light will turn on and off, or twinkle or blink, only as a result of the temperature of the thermally sensitive element in that one light and not as a function of the state of any of the other lights in the same string. Commercially available twinkling lights of this type are manufactured with relatively loose tolerances so that the on/off cycle of different lights will be different, and the time it takes for each thermally sensitive switching element to open will differ. Thus the lights 20 on a given string 12 will shift from on to off in a random manner and the lights 20 forming the string will twinkle or blink in a random or irregular manner. It is this randomness together with the relatively large spacing between lights on the support member or tree that in large part leads to illusion of twinkling starlight or flickering firelight. Since the lights individually provide sufficient illumination, when lit, so that they are visible from a distance, the entire string or multiple strings can be viewed as a whole, even though the length of the string 12 is much greater than normal lighting strings.

Figure 6A:
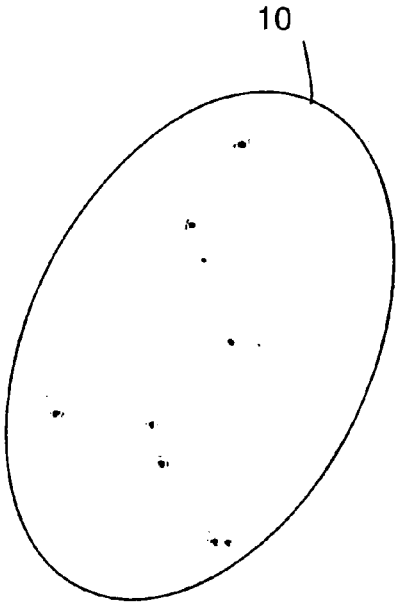
FIGS. 6A-6D show a light string in a tree and demonstrate the progression of blinking lights from the initial start in FIG. 6A in which all of the lights are illuminated, with different lights being illuminated in FIGS. 6B-6D. The image has been inverted in FIGS. 6A-6B so that an illuminated bulb appears as a dark spot.
Figure 6B:
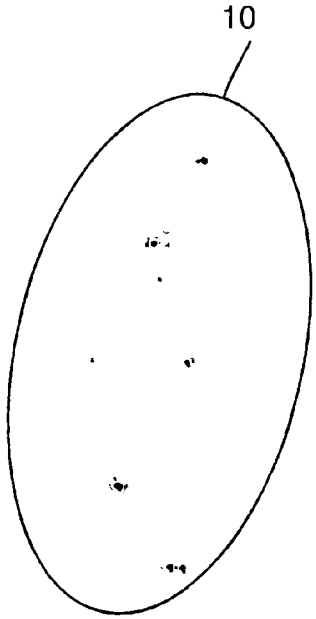
Figure 6C:
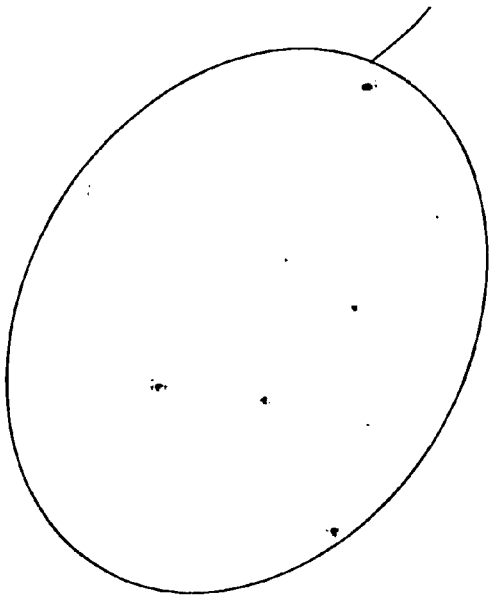
Figure 6D:
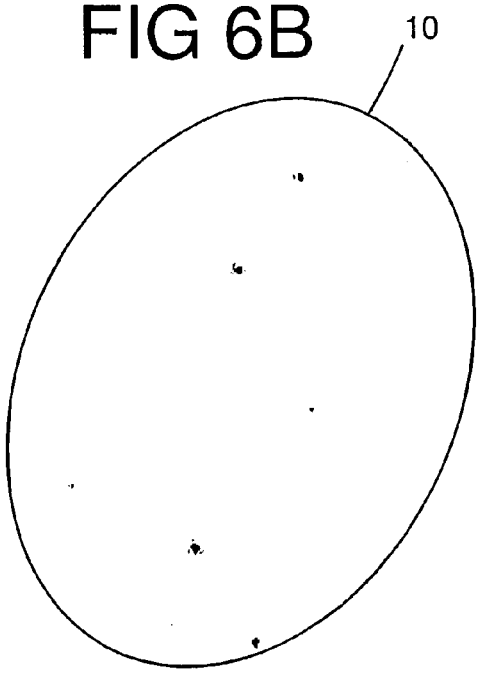

FIGS. 6A-6D, and corresponding photographs 6A'-6D', show the lighting pattern for one string of twelve lights, spaced apart on the string by a distance of six feet, as a function of time. As stated previously, the dark spots in FIGS. 6A-6D show the illuminated lights 20 at specific times. The photographs from which FIGS. 6A-6D are derived are presented as color photographs 6A'-6D'. The oval patterns shown on all of these Figures encircle the illuminated lights on the same deciduous tree having a height of approximately twenty to twenty five feet. FIG. 6A corresponds to a time shortly after current is initiated to the light string 12. There has not been sufficient time for the thermally sensitive switching elements to heat up to the point at which individual lights turn off. FIG. 6A shows only ten of the twelve lights for a given string, but two of the lights are obscured by branches or one of the few remaining leaves on the tree, so that they are not visible in this or any other of the views in FIGS. 6B-6D. Note that not all of the lights appear to have the same intensity, but this to is due to obstruction by tree limbs or to the specific orientation of the light 20 relative to the socket 30. In each view, one of the light point sources appears dimmer than the others, but this effect will be created when the socket shields much of the light because of its orientation relative to the point at which the decorative display 10 is viewed. FIGS. 6B-6D, show subsequent points in time from essentially the same perspective. In each case the lighting pattern is different and irregularly so. As seen in the photographs of FIGS. 6A' to 6D', the individual lights appear suspended in mid-air and the neither tree limbs 4 nor the cord 14 can be seen. Thus when the lights twinkle, they appear to have the effect of twinkling stars in the night sky. Others have described this effect as the illusion of flickering firelight.

Figure 7A:
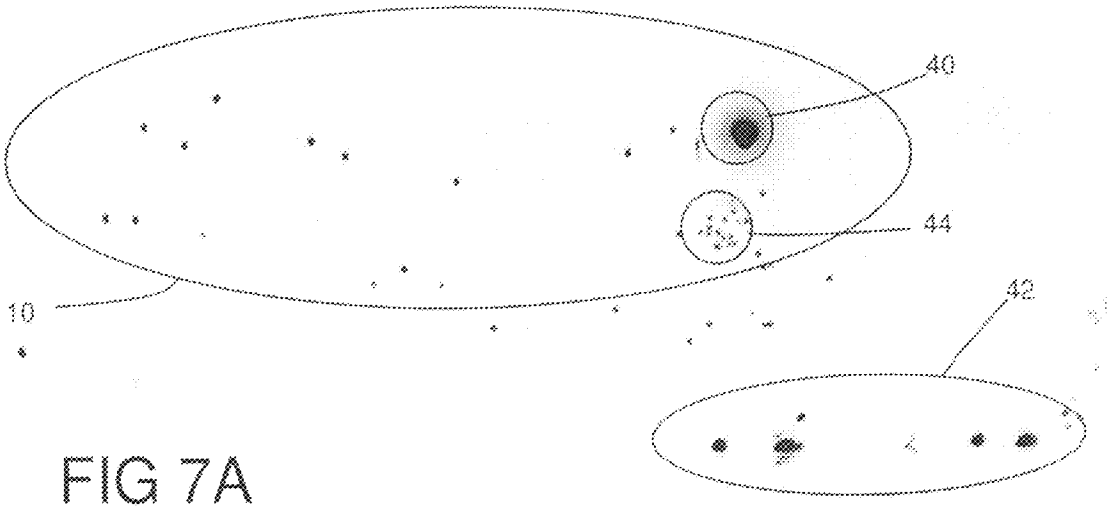
FIGS. 7A and 7B are photographs taken of multiple trees on a street showing the different patterns of blinking lights at two times separated by a short interval.
Figure 7B:
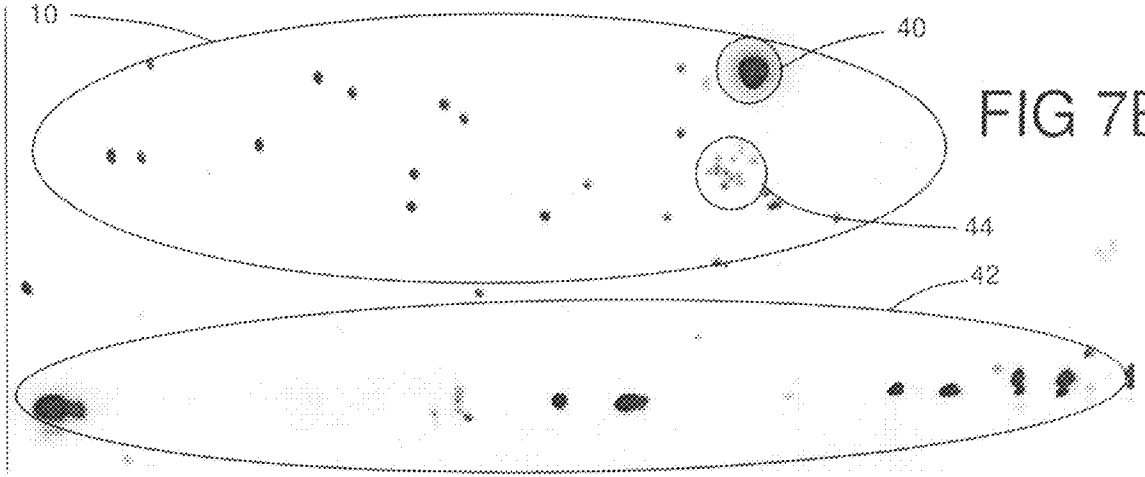
Figure 7A:
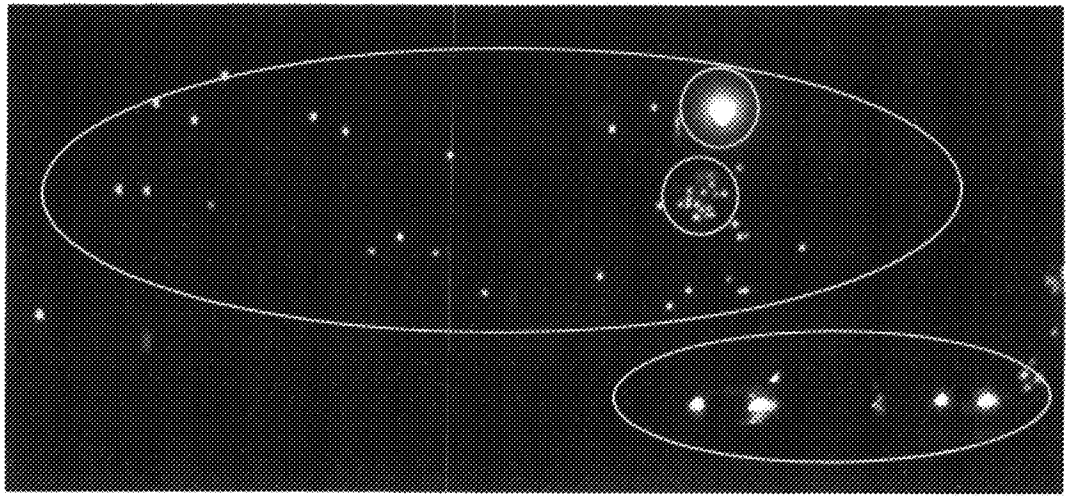
Figure 7B:
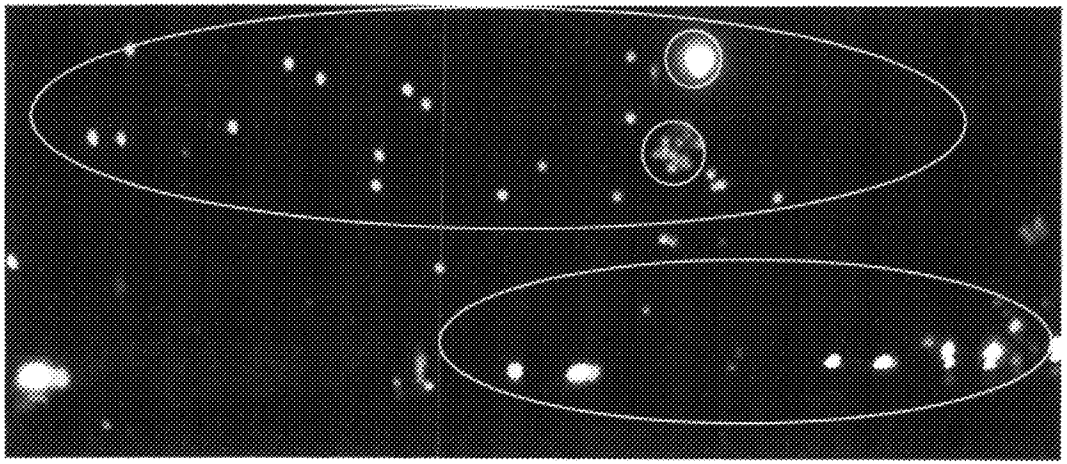

FIGS. 7A and 7B, along with corresponding photographs 7A' and 7B', show the twinkling effect of lights in multiple trees forming a decorative outdoor scene. FIGS. 7A and 7B are derived from photographs showing several trees on the opposite side of a street in a downtown area. Twinkling lights forming a decorative display 10 are identified by the ovals 10 which encircle the twinkling lights. Since these views are of a street scene, decorated for the Christmas holidays, other lights are present as well. A street lamp 40 is present in each Figure. Headlights from passing cars are encircled by oval 42, and the different positions of the cars is illustrated by the different ovals 42 in FIGS. 7A and 7B. A separate lighted Christmas decoration 44 is show in each view. These views show that the effect created by the twinkling lights 20 will not be washed out by extraneous sources of light.

Figure 8B:
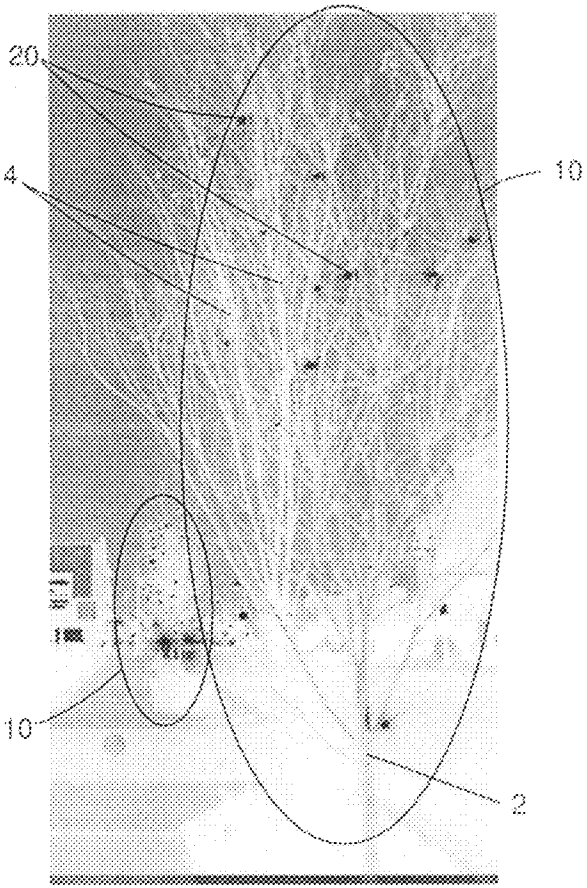
FIGS. 8A and 8B show are views facing along a line of multiple trees on the side of a street in which each tree is decorated with a light string in accordance with this invention.
Figure 8A:
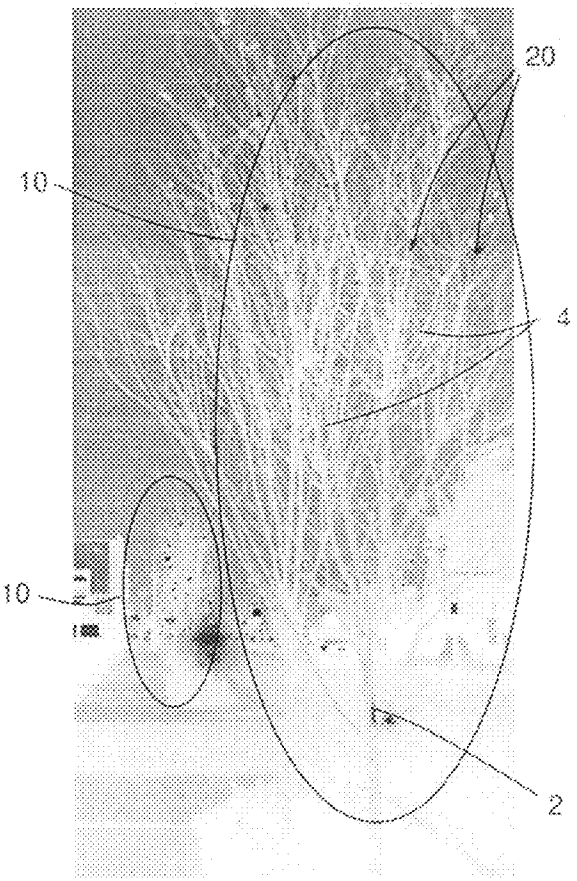
Figure 8B:
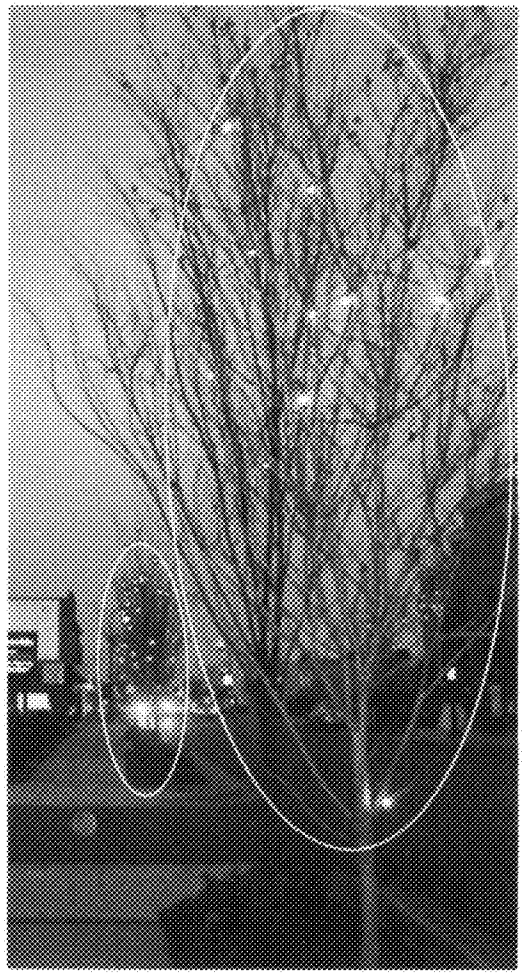
Figure 8A:
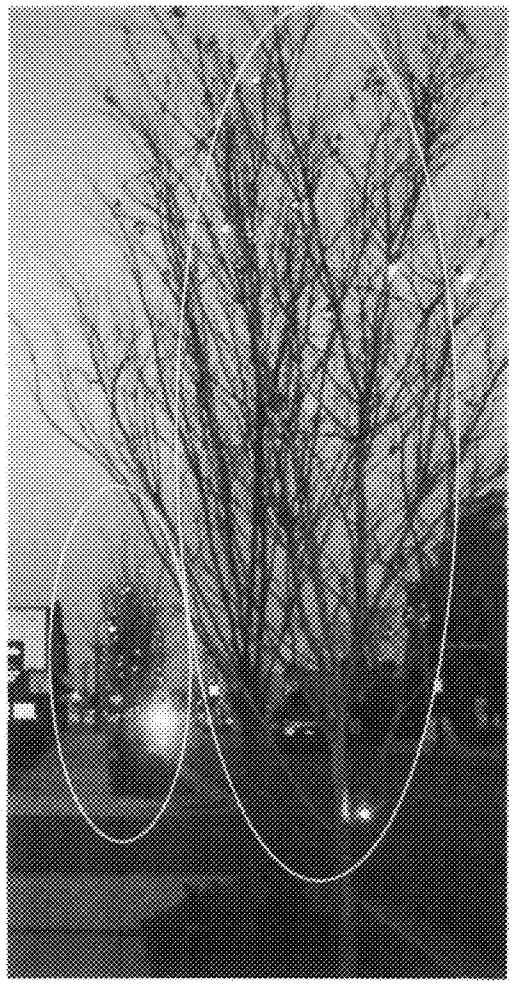

FIGS. 8A and 8B, derived from photographs 8A' and 8B', also show a street scene. These views are taken on the same side of a street showing multiple trees lined up along that street. These views show the appearance of the twinkling lights at dusk rather than full darkness, so the ambient light is greater. Nevertheless, comparison of the two views shows that the decorative array of lights on multiple trees vary at the different points in time represented by FIGS. 8A and 8B. Although the cord can be seen in light conditions of FIGS. 8A and 8B, see the upper left hand portion of the photograph in FIG. 8A, the cord nevertheless blends into the background and the lights form the predominant impression. In the tree in the foreground, it even appears that the individual lights are separate and are not positioned in the tree as part of a lighting string.

Light strings according to this invention can be mounted or hung from trees in a number of different ways. When light strings according to this invention are to be hung from a number of trees, such as trees lining a city street, it may be practical to use a bucket truck, which will permit the installer to place the lights individually at any point on trees having a height of twenty to thirty feet. A light string according to this invention can be placed on individual trees using a ladder, such as a step ladder. The user can also use a pole or rod with a hook on one end to sequentially position the individual lights at desired locations. Normally the individual sockets can be placed near the intersection of small branches and twigs, and the tree will support the light string. When the installer has access to the upper reaches of the tree, the light string can be secured directly to individual branches, preferably near the sockets themselves. Since the sockets are spaced apart by a relatively large distance, the cord can be tied directly to the tree using a simple slip knot. Alternatively, twist ties can be wrapped around the cord and the branches to secure the light string to a tree. Although not essential, this approach will allow installer to attach each light directly to a branch on a tree for greater security.

Another method of mounting the lights on a tree, where the installer does not have access to the top of the tree, is to first hurl a grappling device into the top of the tree. The light string can be attached to the grappling device by a separate cord, before the grappling hook is launched into the tree. Then the light string can be pulled up to the grappling device using the separate cord to anchor the light string at one point to the grappling hook. When using this approach, the light string would normally be secured to the grappling hook near the center of the light string. Lights on opposite sides of this central secured position can then be draped on different branches of the tree as desired. One approach would be to use a May pole technique, in which the portions of the light string on opposite sides of the central anchored position, would be wrapped around the tree. Alternatively, one end of the light string can be secured near the top of the tree, and the remaining portion of the light string can be wrapped around the tree in this manner.

Although the preferred embodiment employs lights spaced apart at a distance of six feet, it should be understood that this dimension is merely representative. Other spacings between adjacent lights can also be employed, but it has been observed that if the spacing is three feet or less, than a busy, or less attractive impression is created. When adjacent lights are spaced apart by three feet, the spacing between adjacent lights will be at least thirty-six times the diameter of the lamp or light base of 0.875 inches. For a six foot spacing between adjacent lights they would be spaced apart by a distance of at least seventy two times the diameter of the lamp or light base of 0.875 inches. The representative embodiment also employs clear bulbs, but other colors or multicolored strings can also be employed. For smaller trees, fewer lights can be used to avoid a busy appearance, so light strings with fewer than twelve lights can also be employed. A long string can be replaced by smaller strings that can be connected together, so that the same number of lights can be mounted on a tree as would be present using a single long string. Shorter strings are less likely to become entangled during storage. Although especially suited for outdoor display when hung from tree limbs, a similar starlight visual effect can be created when the lights are positioned on a black or dark background. For instance when a string of these widely spaced flickering lights are placed against a black background on an indoor wall, it can appear to the viewer that he or she is looking outside into the night sky filled with flickering stars. In the preferred embodiment, incandescent lights are employed. It is understood, however, the incandescent lights can be replaced by light emitting diodes. Appropriate circuitry can be provided to randomly light individual LED's mounted on a string. Other configurations and dimensions can be altered by one of ordinary skill in the art, and this invention is not therefore limited to the specific embodiment described herein.

I claim:

1. An outdoor decorative display comprising a string including a plurality of electrical lights mounted on a cord, the string including a plurality of sockets regularly spaced between opposite ends of the cord to which the electrical lights are connected, all of the sockets being mutually electrically in parallel, adjacent sockets being equally spaced apart on the cord by a distance of at least three feet so that adjacent electrical lights can be irregularly spaced apart when mounted on an outdoor member with portions of the cord being slack between adjacent sockets so that adjacent electrical lights are irregularly spaced apart when mounted, wherein the individual lights are intermittently illuminatable for different durations so that the plurality of electrical lights when disposed in a three dimensional space, form random, illuminated, intermittent, time varying twinkling, irregular patterns of discrete light point sources formed by adjacent lights spaced apart sufficiently to eliminate the perception of an ordered array of lights, the relative spacing of at least three feet between adjacent lights and the random intermittent illumination of the lights eliminating any visual appearance of lights strung together in a line or in a regular geometrical pattern.

2. The outdoor decorative display of claim 1 wherein each individual light is individually illuminated independent of other lights that are part of the string.

3. The outdoor decorative display of claim 2 wherein each individual light includes a switch, which opens when heated by the passage of an electrical current through the switch and closes when cooled in the absence of an electrical current though the switch so that the lights are illuminated independently of other lights in the string.

4. The outdoor decorative display of claim 2 wherein adjacent lights on the entire string are spaced apart by a distance of six feet.

5. The outdoor decorative display of claim 2 wherein adjacent lights on the entire string are spaced apart by a distance of three feet and over thirty six times a diameter of each light base of the adjacent lights.

6. The outdoor decorative display of claim 1 wherein string includes incandescent C7, 7 watt/120 volt candelabra, clear twinkle lights.

7. The outdoor decorative display of claim 1 wherein individual electrical lights emit light of at least 40 lumens.

8. The outdoor decorative display of claim 7 wherein all of the electrical lights on the string individually emit light of at least 40 lumens.

9. The outdoor decorative display of claim 8 wherein adjacent lights on the entire string are spaced apart by a distance of six feet.

10. The outdoor decorative display of claim 1 wherein adjacent lights are sufficiently spaced apart so that the lights can be irregularly suspended from limbs of a deciduous tree, which has lost the majority of its leaves, and which comprises the outdoor member, so that the lights twinkle in an irregular manner to create an impression of twinkling starlight when the ambient light is small enough so that the limbs and the tree are less visible than the individual randomly, twinkling lights.

11. A method of decorating a tree comprising the steps of:

suspending a light string from limbs of the tree with the light string having electrical lights regularly spaced on an electrical cord with a minimum spacing of three feet between adjacent lights, the lights being suspended from the limbs with slack being formed in the cord between some of the lights so that the lights are irregularly spaced on the tree;

connecting the light string to a source of electricity so that the electric lights randomly blink so that only a portion of the lights are simultaneously illuminated at any one time, with individual lights remaining illuminated so that the light string creates a twinkling effect, with the lights being sufficiently dispersed on the tree so that the lights do not appear to be strung together in a line or in a regular geometrical pattern.

12. The method of claim 11 wherein the light string is suspended from the limbs of a deciduous tree, which has lost most of its leaves so that individual lights appear suspended in midair against a night sky to create an appearance of twinkling stars.

13. The method of claim 11 wherein adjacent lights have a spacing on the electrical cord of at least six feet.

14. The method of claim 13 wherein the light string is hung from tree limbs of the deciduous tree, primarily on only one side without encircling the trees, the twinkling lights remaining visible from all directions.

15. The method of claim 11 wherein the individual lights emit an illumination of at least 40 lumens when on.

16. The method of claim 11 wherein the individual lights blink on and off independently of the other lights on the string.

17. A method of decorating a scene to simultaneously create the illusions of twinkling starlight and of flickering firelight at night, the method comprising the steps of:

suspending light strings from outdoor tree limbs in which adjacent electric sockets on the string are spaced apart by a distance of between three feet and six feet on the strings, but are irregularly spaced on the supporting members;

connecting blinking electric lights in the sockets so that lights in each string blink on and off randomly and independent of the other blinking lights in the string with the lights being illuminated for different, independent durations so that there is no discernible pattern of illumination or light pattern, so that when the scene is viewed from a distance, the lights twinkle at random intervals and the spacing between illuminated lights continuously changes to create the simultaneous illusion of twinkling starlight and flickering flames.

18. The method of claim 17 comprising the method of decorating a street in which the supporting members are trees lining the street.

* * * * *